US010894260B2

(12) United States Patent
Eberle et al.

(10) Patent No.: US 10,894,260 B2
(45) Date of Patent: Jan. 19, 2021

(54) CENTRIFUGE REFRIGERATION VIA MAGNETOCALORIC SYSTEM

(71) Applicant: ANDREAS HETTICH GMBH & CO. KG, Tuttlingen (DE)

(72) Inventors: Klaus-Guenter Eberle, Tuttlingen (DE); Matthias Hornek, Tuttlingen (DE); Wolfgang Preter, Singen (DE)

(73) Assignee: ANDREAS HETTICH GMBH & CO. KG, Tuttlingen (DE)

( * ) Notice: Subject to any disclaimer, the term of this patent is extended or adjusted under 35 U.S.C. 154(b) by 1014 days.

(21) Appl. No.: 15/313,554

(22) PCT Filed: Mar. 17, 2015

(86) PCT No.: PCT/EP2015/055589

§ 371 (c)(1),
(2) Date: Nov. 22, 2016

(87) PCT Pub. No.: WO2015/176841

PCT Pub. Date: Nov. 26, 2015

(65) Prior Publication Data

US 2017/0189916 A1 Jul. 6, 2017

(30) Foreign Application Priority Data

May 23, 2014 (DE) ..... 10 2014 107 294

(51) Int. Cl.
*B04B 15/02* (2006.01)
*B04B 7/02* (2006.01)
*B04B 7/06* (2006.01)

(52) U.S. Cl.
CPC ..... *B04B 15/02* (2013.01); *B04B 7/02* (2013.01); *B04B 7/06* (2013.01)

(58) Field of Classification Search
CPC ..... B04B 15/02; B04B 7/02; B04B 7/06
(Continued)

(56) References Cited

U.S. PATENT DOCUMENTS 2,608,344 A * 8/1952 Pickels ..... B04B 15/08 494/1
2,765,978 A * 10/1956 Strezynski ..... B04B 15/02 494/14

(Continued)

FOREIGN PATENT DOCUMENTS

DE 1033446 12/1963
DE 2807093 9/1978

(Continued)

OTHER PUBLICATIONS

European Patent Office, International Search Report, dated Jun. 29, 2015, pp. 1-12, International Application No. PCT/EP2015/055589, Applicant: Andreas Hettich GmbH.

(Continued)

*Primary Examiner* — Charles Cooley
(74) *Attorney, Agent, or Firm* — Woodling, Krost and Rust

(57) ABSTRACT

A centrifuge (10) having a safety vessel (30) with a vessel wall (32), a rotor (17), which is arranged in the safety vessel (30) and is connected via a drive shaft (20) to a drive device (22), wherein at least the drive shaft (20) extends through the safety vessel (30), a cooling system for cooling an interior space (31) of the safety vessel (30), which comprises a heat transfer medium (19) for taking up heat from the safety vessel (30), a refrigerating unit (12) and conducting pipelines (18) for the heat transfer medium (19). The invention is distinguished by the fact that the refrigerating unit (12) is based on the magnetocaloric effect, and the interior space (31) of the safety vessel (30) is cooled by a first cooling circuit (111), the magnetocaloric effect of the refrigerating unit (12) extracts heat from the heat transfer medium (19) of the first cooling circuit (111) and feeds the heat to a second cooling circuit (113).

10 Claims, 5 Drawing Sheets

(58) Field of Classification Search
USPC ..... 494/14
See application file for complete search history.

(56) References Cited

U.S. PATENT DOCUMENTS 2,917,229 A * 12/1959 Di Benedetto ..... B04B 15/02 494/14
3,129,174 A * 4/1964 Pickels ..... B04B 15/06 494/1
3,347,453 A * 10/1967 Goergen ..... B04B 5/0421 494/1
3,409,212 A * 11/1968 Durland ..... B04B 15/02 494/1
3,600,900 A * 8/1971 Buddecke ..... B04B 5/0414 62/3.2
3,604,617 A * 9/1971 Patterson ..... B04B 5/04 494/15
3,981,437 A * 9/1976 Hemfort ..... B01L 7/00 494/14
4,053,104 A * 10/1977 Penhasi ..... B01L 7/00 494/14
4,512,758 A * 4/1985 Wedemeyer ..... F25B 21/02 494/13
4,690,669 A * 9/1987 Williams ..... B04B 15/02 366/144
4,785,637 A * 11/1988 Giebeler ..... B04B 15/02 165/185
4,917,179 A * 4/1990 Giebeler ..... B04B 15/02 164/95
4,941,866 A * 7/1990 Gorodissky ..... B04B 15/02 494/14
5,433,080 A * 7/1995 Boeckel ..... B04B 15/02 62/3.2
5,551,241 A * 9/1996 Boeckel ..... B04B 15/02 494/14
5,619,422 A * 4/1997 Nakazawa ..... B04B 15/02 318/471
5,653,672 A * 8/1997 Niinai ..... B04B 15/02 494/14
5,724,819 A * 3/1998 Boeckel ..... B04B 15/02 494/13
6,866,621 B1 * 3/2005 Muller ..... B04B 15/02 494/14
7,481,064 B2 * 1/2009 Kitanovski ..... F25B 21/00 62/3.1
7,485,085 B2 * 2/2009 Shigeura ..... B01L 3/50851 435/91.2
7,643,236 B2 * 1/2010 Ohkawara ..... B04B 13/00 360/55
2005/0043163 A1 * 2/2005 Malugvist ..... B01L 7/52 494/14
2010/0000228 A1 * 1/2010 Wiest ..... F25B 21/00 62/3.1
2011/0030939 A1 * 2/2011 Carroll ..... F28F 7/00 165/185
2011/0302930 A1 12/2011 Sohn
2015/0007582 A1 * 1/2015 Kim ..... F25B 21/00 62/3.1
2015/0080202 A1 * 3/2015 Mueller ..... B04B 15/02 494/7
2016/0069596 A1 * 3/2016 Moors ..... F25B 21/00 62/3.1
2017/0189916 A1 * 7/2017 Eberle ..... B04B 7/02
2017/0209874 A1 * 7/2017 Hornek ..... B04B 15/02

FOREIGN PATENT DOCUMENTS

DE 202007001853 5/2008
DE 102012207694 11/2012
DE 102012002593 8/2013
DE 102018114450 A1 * 12/2019
EP 0335475 A2 * 10/1989 ..... B04B 15/02
EP 2335830 6/2011
WO WO-2007101433 A1 * 9/2007 ..... B60H 1/2215
WO WO-2015094686 A1 * 6/2015
WO WO-2019238891 A1 * 12/2019 ..... B04B 7/06

OTHER PUBLICATIONS

Voigt, Andrea, Magnetische Kuhlung: Eine Revolution in Der Kaltetechnik?, Die Kaelte & Klimatechnik, Aug. 2006, XP002740892.
German Patent and Trademark Office, Search Report, dated Jan. 27, 2015, pp. 1-8, Application No. 102014107294.4, Applicant: Andreas Hettich GmbH & Co. KG.
Kuhltechnik: Strom Sparen Mit Magneten Chip, 2013.
German Patent and Trademark Office, German Examination Report, dated Jun. 24, 2016, pp. 1-4, Application No. 102014107294.4, Applicant: Andreas Hettich GmbH & Co. KG.
The International Bureau of WIPO, International Preliminary Report on Patentability, dated Dec. 8, 2016, pp. 1-8, Application No. PCT/EP2015/055589, Applicant: Andreas Hettich GmbH & Co. KG.
The International Bureau of WIPO, Translation of the International Preliminary Report on Patentability, dated Dec. 8, 2016, pp. 1-9, Application No. PCT/EP2015/055589, Applicant: Andreas Hettich GmbH & Co. KG.

* cited by examiner

CENTRIFUGE REFRIGERATION VIA MAGNETOCALORIC SYSTEM

This patent application is the national phase entry of PCT/EP2015/055589. PCT/EP2015/055589, international application filing date Mar. 17, 2015, claims the benefit and priority of and to German patent application DE No. 10 2014 107 294.4, filed May 23, 2014.

PCT/EP2015/055589, international application filing date Mar. 17, 2015 and German patent application no. DE 10 2014 107 294.4, filed May 23, 2014 are incorporated herein by reference hereto in their entireties.

FIELD OF THE INVENTION

The invention relates to a centrifuge.

BACKGROUND OF THE INVENTION

Undesired heat is generated during the operation of a centrifuge, which heat has a damaging effect on the material to be centrifuged. What is especially problematic here is that, for safety reasons, the centrifuge rotor whose rotation and the resulting atmospheric friction produces most of the heat is usually arranged within a vessel firmly sealed by a lid, which makes it difficult for the heat to escape. Often, for biological samples, a temperature of 4° C. often is required and has to be maintained during centrifugation. Active cooling is therefore indispensable, especially for longer operating times and high speeds of rotation, and sample temperatures below ambient temperature.

Various approaches for cooling centrifuges are known in the prior art. Particularly frequent is the use of compressor-based cooling systems for this purpose. While this type of cooling has been tried and tested and proven reliable, it also has a number of disadvantages. First of all, the use of compressed media for heat extraction makes it necessary to use conducting means such as copper pipes which are capable of withstanding pressures of the order of approx. 25 bar. However, copper pipes are not only expensive, their rigidity limits their use to certain places of a centrifuge, and they provide a relatively small heat-transfer surface. Secondly, temperature is usually controlled using a two-point control, i.e. by switching the compressor on and off. The more precisely the temperature is to be set, the more frequently the compressor will have to be turned on and off. This results in additional vibration of the rotor and/or the centrifuge, in addition to the usual vibration in operation, which has a detrimental effect on the material to be centrifuged and the service life of the centrifuge. Frequently turning the centrifuge off and on also increases the power consumption of the device. Furthermore, the use of refrigerants may be problematic from various points of view, besides the above mentioned high pressures. On the one hand, the use of flammable refrigerants in centrifuges is prohibited for safety reasons. On the other hand, there are more and more legal restrictions concerning the environmental compatibility of the refrigerants. It may thus sometimes be a challenge to find reliable, admissible and low-cost refrigerants suitable for cooling centrifuges.

SUMMARY OF THE INVENTION

It is the object of the present invention to provide a centrifuge which does not have the above mentioned disadvantages and which can be cooled efficiently and in a low-cost manner, whose operation is low in vibration and thus gentle on the product, and which is unproblematic from a safety point of view.

The invention is based on the finding that conventional refrigeration systems for centrifuges, in particular compression refrigeration systems, can be replaced with magnetocaloric cooling and that in this way, a centrifuge can be created in a simple manner which is safer, more economical and gentler in operation than conventional centrifuges. Moreover, this results in a number of new design options for optimizing the centrifuge even further.

According to the invention, the centrifuge has a safety vessel with a vessel wall, a rotor which is arranged in the safety vessel and is connected via a drive shaft to a drive device, wherein at least the drive shaft extends through the safety vessel, and a cooling system for cooling the interior space of the safety vessel, which comprises a heat transfer medium for taking up heat from the safety vessel, a refrigerating unit and conducting means for the heat transfer medium. The refrigerating unit is based on the magnetocaloric effect. The interior space of the safety vessel is cooled by a first cooling circuit. The magnetocaloric effect of the refrigerating unit extracts heat from the heat transfer medium of the first cooling circuit and feeds the heat to a second cooling circuit. The refrigerating unit contains magnetocaloric material which will heat up when exposed to a magnetic field, and which will cool down again once said magnetic field is removed. Cyclically exposing this magnetocaloric material to a magnetic field and circulating a heat transfer medium of the second cooling circuit around said material will cause heat to be extracted from said material, and circulating a heat transfer medium of the first cooling circuit around said material to which heat is released will trigger a heat transfer process. In other words, the heat transfer medium of a first cooling circuit—the so-called cold circuit—and the heat transfer medium of a second cooling circuit—the so-called heat circuit—will alternately and repeatedly circulate around the magnetocaloric material, in a manner synchronized to the magnetic field. This has the advantage that the use of a compression refrigeration system and a refrigerant suitable for this purpose can be dispensed with. Eliminating the compressor will result in smoother operation of the centrifuge and thus gentler handling of the material to be centrifuged, as there will be no vibrations and no agitation caused thereby. Furthermore, power consumption will be lower since there will be no constant turning on and off of a compressor which requires a lot of power. Moreover, the thermodynamic efficiency of magnetic refrigeration systems is higher than that of conventional compression-based refrigeration systems. Further advantages of this magnetocaloric refrigeration which result in cost savings will be explained in more detail below.

Considered particularly advantageous is the use of cooling water as a heat transfer medium, which water additionally contains additives such as salt or alcohol which will reduce the freezing point. These solutions are inexpensive, environmentally friendly and non-flammable.

More specifically, the conducting means for the heat transfer medium are designed as low-pressure lines for an operating pressure of below 3 bar. This is a simple way of expanding the constructive design options for the conducting means. For example, by suitably designing the conducting means, a larger surface will be available for heat extraction. Moreover, flexible materials can now also be used which can be adapted better to the surfaces to be cooled, thus enabling more efficient cooling. Furthermore, the flexible materials are usually also lighter in weight and less expensive than the materials used for high-pressure lines, e.g. copper.

In one aspect of the present invention, a control or regulating unit is provided which can be used to control or regulate the refrigerating unit and thus to adjust the temperature of the safety vessel interior. This ensures that, depending on the individual application and operating status, a predetermined optimum temperature will be maintained within the centrifuge.

For conveying the heat transfer medium through the conducting means, pumps are provided in each circuit. Here it is advantageous for the pumps to be capable of also being controlled and/or regulated by the control or regulating unit. In this way, the temperature within the centrifuge can be additionally adjusted via the amount and the rate of the heat transfer medium conveyed through the conducting means.

In an advantageous further embodiment of the invention, the safety vessel has an interior which faces the rotor and an exterior which cooperates with the cooling system, and the conducting means of the first cooling circuit is at least in some parts formed by the safety vessel, so that the heat transfer medium has direct surface-area contact with the vessel wall exterior of the safety vessel and flows over it. This is advantageous in that direct contact of the heat transfer medium with the vessel wall makes for more efficient cooling than can be achieved by means of a heat transfer medium which flows through lines which are for example provided on the exterior of the safety vessel.

It is advantageous for the heat transfer medium to be guided through the conducting means in a concentric manner about a central axis of the safety vessel. This allows for uniform cooling of the vessel interior.

In one aspect of the present invention, in some parts of the conducting means, the heat transfer medium is guided in parallel and/or radially relative to the central axis of the safety vessel. Thus, the structural conditions of the centrifuge can be taken into account and it is possible to cool a larger surface of the vessel wall.

In yet another advantageous embodiment of the invention, the safety vessel is of a double-wall design having an interior wall and an exterior wall. The heat transfer medium flows between the interior and exterior walls, in which case it makes direct surface contact with the exterior of the safety vessel interior wall and flows over it. Consequently, this makes it possible to cool almost the entire surface of the safety vessel interior wall whilst the exterior wall may have insulation formed thereon, for example.

In accordance with one embodiment of the invention, it has proven advantageous for the interior wall to form an interior vessel and for the exterior wall to form an exterior vessel, with the interior and exterior vessels being arranged concentrically to one another, wherein the interior and exterior vessels are matched to each other proportionally in such a way that, in certain areas, the interior and exterior walls are uniformly spaced from each other. This facilitates production of the safety vessel and allows a more uniform flow of heat transfer medium between the interior and exterior walls.

To provide better control of the flow of the heat transfer medium and to effect even more uniform cooling, it is advantageous to provide flow directing means, in particular made of plastic or sheet metal, between the interior and exterior walls, which are part of the conducting means.

In an advantageous further development of the invention, conducting means are provided which are incorporated into the material of the safety vessel wall. This on the one hand determines the flow paths of the heat transfer medium, which further improves the cooling action. On the other hand, this makes the safety vessel design more robust which has a positive effect on the safety of the centrifuge.

In an alternative embodiment, mutually associated recesses are provided in the exterior of the interior wall and in the interior of the exterior wall, which recesses, taken together, form the conducting means, i.e. the safety vessel cooling duct. Hence it is no longer necessary to incorporate separate components for the lines into the safety vessel wall, which in turn makes production of the safety vessel easier and cheaper.

Moreover, it is considered advantageous to provide an inlet of the heat transfer medium into the safety vessel conducting means and an outlet of the heat transfer medium, and to arrange either the inlet in the area of the upper edge of the safety vessel and the outlet in the area of a vessel bottom of the safety vessel, or the other way around. So, from a vertical perspective, after heat extraction, the heat transfer medium can be introduced on the one side of the safety vessel, and can be withdrawn on the other side of the safety vessel.

In yet another advantageous embodiment, following the inlet is an annular manifold which preferably extends in one plane. In particular in combination with the above described conducts which at least in parts extend in parallel to the central axis of the safety vessel, this will ensure fast and uniform distribution of the cooled heat transfer medium.

It has also proved useful to provide an annular collector duct, which preferably extends in one plane, upstream of the outlet. This design simplifies the removal of the heat transfer medium after it has passed through the wall.

With a view to simplifying production and reducing production costs, it is considered advantageous to use an aluminum part made in a pressure die-casting process for the vessel wall. Equally suited for this purpose is zinc.

In an alternative embodiment, U-shaped line profiles are fitted onto the exterior of the vessel wall, which constitute the conducting means of the safety vessel. In this case, the U shape is closed by the vessel wall so that—viewed in cross-section of the line profile—both legs extend towards the vessel wall. This may be advantageous for solutions which are aimed especially at saving space and weight since a single-wall safety vessel has smaller outer dimensions and is of lower weight. However, these solutions still benefit from the advantage that the heat transfer medium passes directly over the wall of the safety vessel.

In one aspect of the present invention, a centrifuge lid is provided which has conducting means incorporated into it or fitted onto it that are connected to the refrigerating unit. Consequently, the heat transfer medium can also be used for more efficient cooling of the centrifuge lid.

In another embodiment of the invention, the drive device is at least partially surrounded by conducting means for the heat transfer medium which are connected to the refrigerating unit. This thus also effects direct cooling of the drive device which is one cause for major heat input in the safety vessel.

In this case, it is advantageous to have the portion of the drive device which is surrounded by conducting means project into the safety vessel. For such an arrangement, cooling can easily be effected technically, for example by means of a hood including conducting means which is placed on the portion of the drive device which projects into the safety vessel and mounted thereon. In this case, cooling is effected both of the drive device and of the interior space of the safety vessel.

In yet another advantageous embodiment of the invention, heat transfer medium conducting means which are connected to the refrigerating unit are integrated in the drive device. This kind of cooling is efficient and in particular space saving.

In yet another embodiment of the invention, the safety vessel is a deep-drawn vessel made from steel plate, in particular stainless steel plate. This lowers production costs and makes for a longer service life of the safety vessel.

Additional advantages, features and possible applications of the present invention may be gathered from the description which follows, in which reference is made to the embodiments illustrated in the drawings.

Throughout the description, the claims and the drawings, those terms and associated reference signs are used as are indicated in the list of reference signs which follows below.

DESCRIPTION OF THE INVENTION

Figure 1:
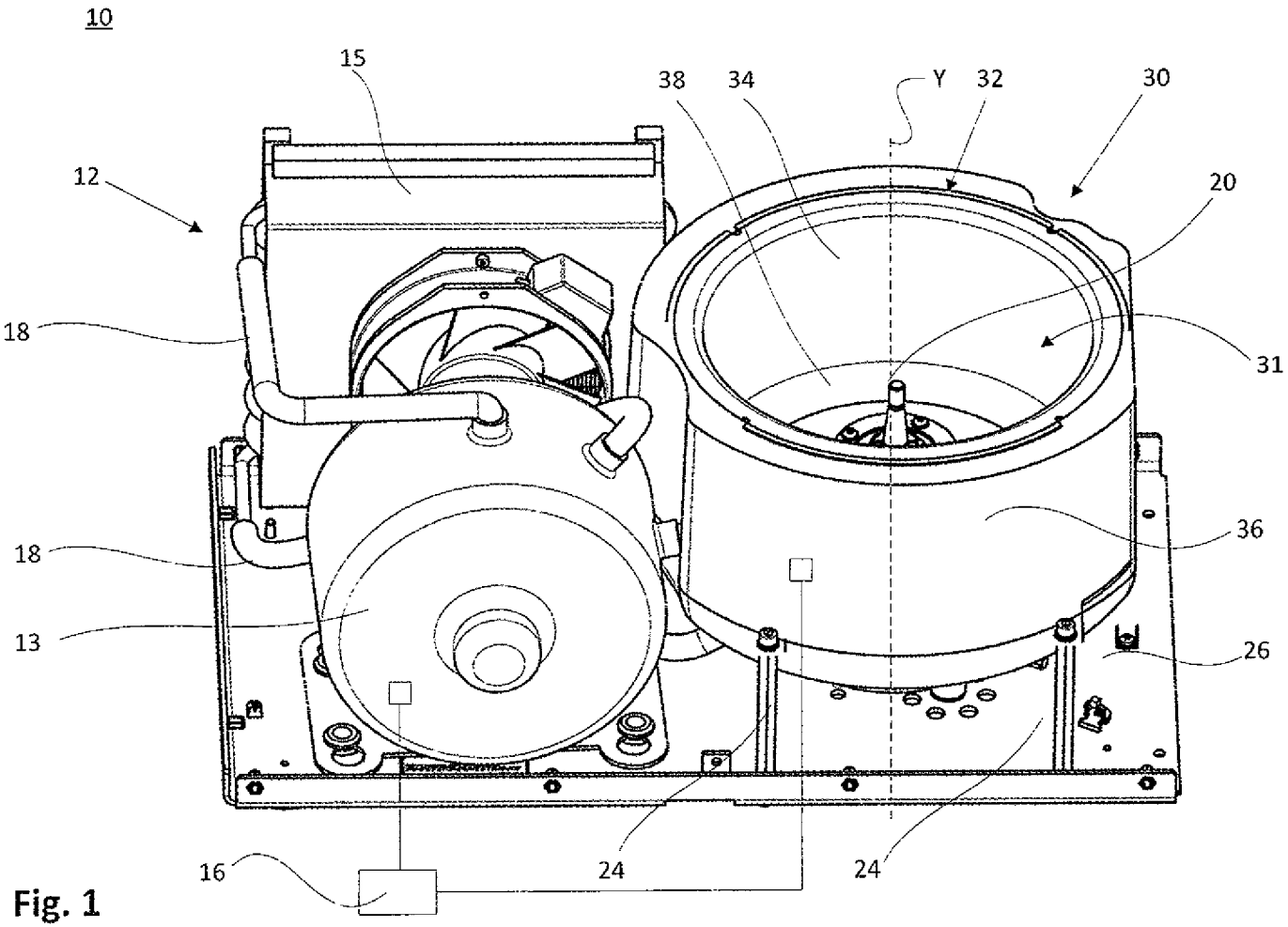
FIG. 1 is a schematic perspective view of a centrifuge of the invention having a magnetocaloric refrigerating unit.

The view of FIG. 1 is a schematic perspective view of a centrifuge 10 of the present invention having a magnetocaloric refrigerating unit 12 and provides an overview of the basic structure.

A safety vessel 30 of the centrifuge 10 is mounted on a base plate 26 together with the magnetocaloric refrigerating unit 12. The magnetocaloric refrigerating unit 12 essentially comprises a cooling aggregate 13 having a stator mounted therein which is not shown in the drawings, a heat exchanger 15, a pump device (not shown) and a regulating unit 16. Heat transfer medium 19 flows through a system of conducting means 18 in a first cooling circuit 111 between the magnetocaloric refrigerating unit 12 and the safety vessel 30. The first cooling circuit 111 of the heat transfer medium 19 will be explained in more detail with reference to the embodiments shown in the figures which follow.

The safety vessel 30 has a vessel wall 32 with an interior space 31, an interior 34, an exterior 36 and a vessel bottom 38. Conducting means 18 for the heat transfer medium 19 are provided for cooling the interior space 31 of the safety vessel 30, which conducting means 18 are not shown in FIG. 1 and whose various embodiments according to the present invention will be explained with reference to the figures which follow. A drive shaft 20 extends through the vessel bottom 38 along a central axis Y of the safety vessel 30, via which a rotor 17, which is not shown in the drawings for reasons of clarity, is connected to a drive device 22 which is arranged below the safety vessel 30 and not visible from this perspective. The safety vessel 30 is mounted on the base plate 26 via four fastening struts 24, of which only two can be seen in this perspective view.

Figure 2:
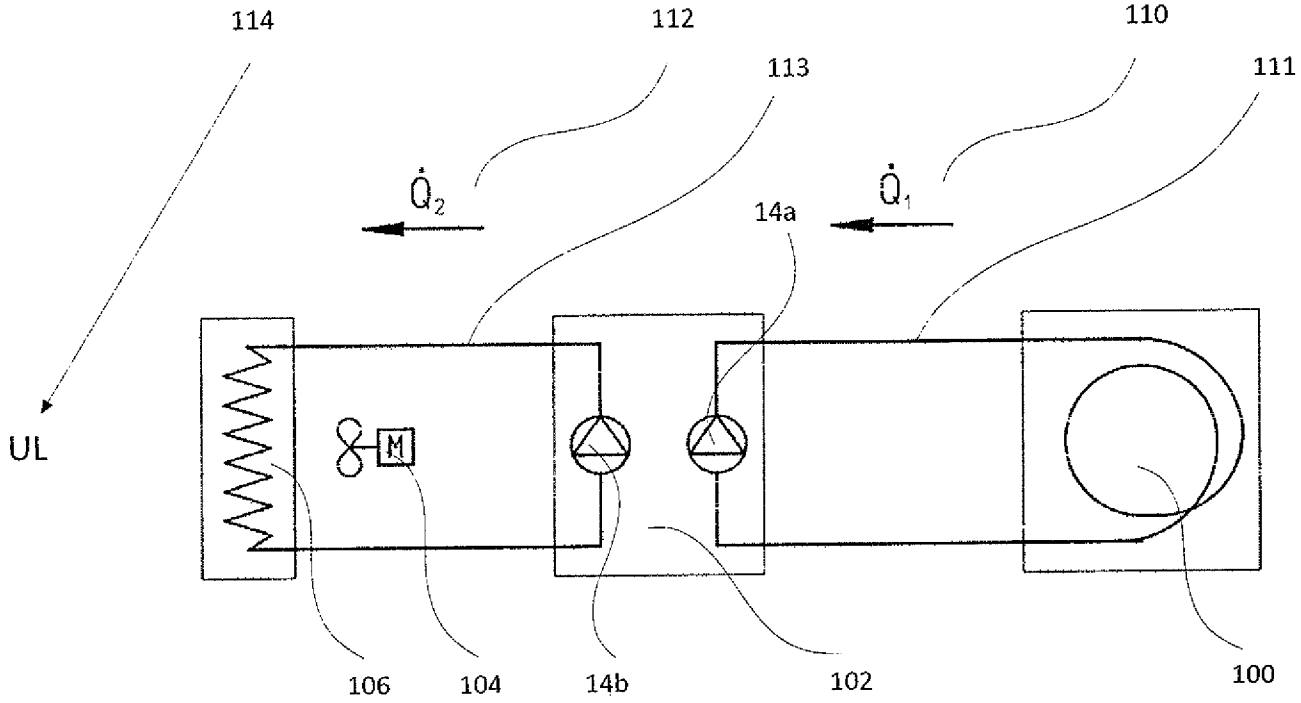
FIG. 2 is a schematic graph of the magnetocaloric refrigeration principle.

FIG. 2 is a schematic view of the known principle of the magnetocaloric cooling of a centrifuge 100. On a cold side 110, heat transfer medium 19 circulates in said first cooling circuit 111—the cold side 110—from which heat is extracted when said magnetocaloric material is periodically exposed to a magnetic field in the cooling aggregate 13 and heats up. As the magnetocaloric material leaves the magnetic field, it will transfer the stored heat to the heat transfer medium 19 of a second cooling circuit 113—the warm side 112. Included in the second cooling circuit 113 is a heat exchanger 106 which gives off the heat to the ambient air. The heat delivery is improved by the use of a ventilator 104. Provided in the first cooling circuit 111 is a pump 14*a*, and provided in the second cooling circuit 113 is a pump 14*b* which are each used to convey the heat transfer medium 19. Magnetocaloric cooling units are basically known, for which reason a more detailed explanation is not considered necessary here.

Figure 3:
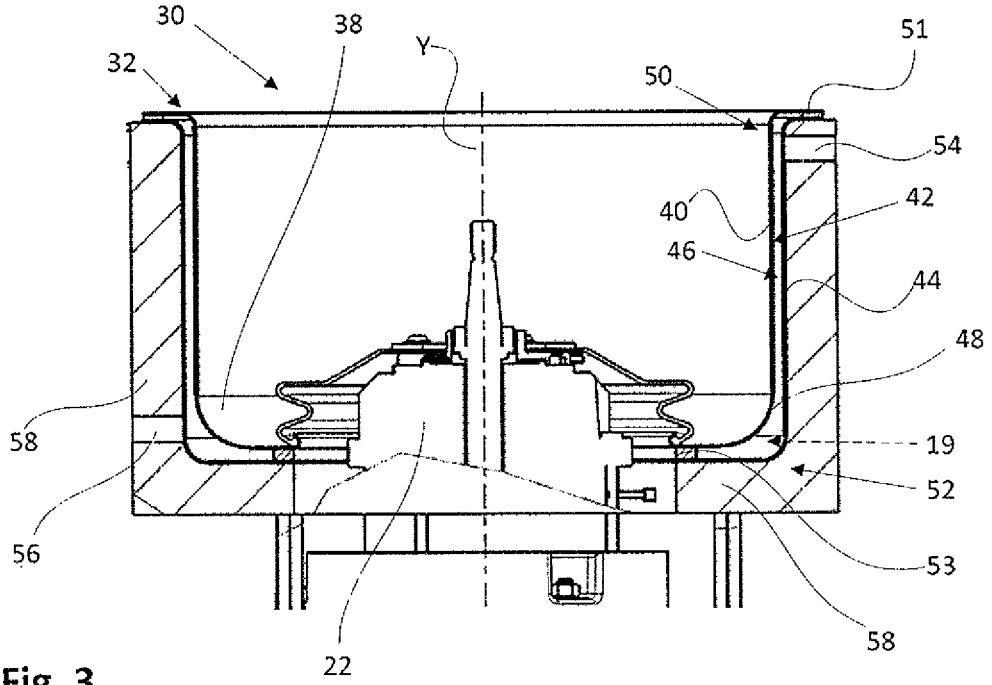
FIG. 3 is a lateral sectional view of the safety vessel of a centrifuge of the present invention.

FIG. 3 is a lateral sectional view of the safety vessel 30 of a centrifuge 10 of the present invention. The vessel wall 32 of the safety vessel 30 is of a double-wall design having an interior wall 40 which has an exterior 42 that faces away from the interior space 31 of the safety vessel 30 and an exterior wall 44 which has an exterior 46 that faces away from the interior space of the safety vessel 30. The double wall design of the vessel wall 32 serves as a conducting means 18 for the heat transfer medium 19 in the safety vessel 30. An unimpeded intermediate space 48 between the exterior 42 of the interior wall 40 and the interior 46 of the exterior wall 44 extends from a first end portion 50 at the upper end of the vessel wall 32 to a second end portion 52 below the vessel bottom 38 and is used for containing the heat transfer medium 19. The first end portion 50 of the intermediate space 48 is provided with a seal 51, and the second end portion 52 of the intermediate space 48 is provided with a seal 53 so as to prevent heat transfer medium 19 from escaping from the intermediate space 48 in an uncontrolled manner.

Via conducting means 18, the heat transfer medium 19 previously cooled in the magnetocaloric refrigerating unit 12 in the manner described above flows to a feed line 54 provided in a first end portion below the seal 51 which feed line 54 feeds the medium 19 into the intermediate space 48. In the intermediate space 48, the heat transfer medium 19 circulates concentrically around the central axis Y of the safety vessel 30, thereby cooling especially the interior wall 40 through direct surface contact with the exterior 42 of the latter. Finally, the heat transfer medium 19 exits the intermediate space 48 via a discharge line 56 which then feeds it back to the magnetocaloric refrigerating unit 12. Insulation 58 is provided around the safety vessel and rests against the exterior of the exterior wall 44 and is only penetrated by the feed line 54, the discharge line 56 and the drive device 22 which latter extends into the safety vessel 30 through the vessel bottom 38.

For enhanced control of the flow of the heat transfer medium 19, it is also possible to provide flow directing elements in the intermediate space 48 between the interior wall 40 and the exterior wall 44. Furthermore, it is also conceivable to position the interior wall 40 and the exterior wall 44 without any space between them, and to form the conducting means 18 in the safety vessel 30 by mutually associated recesses in the interior wall 40 and the exterior wall 44.

Figure 4:
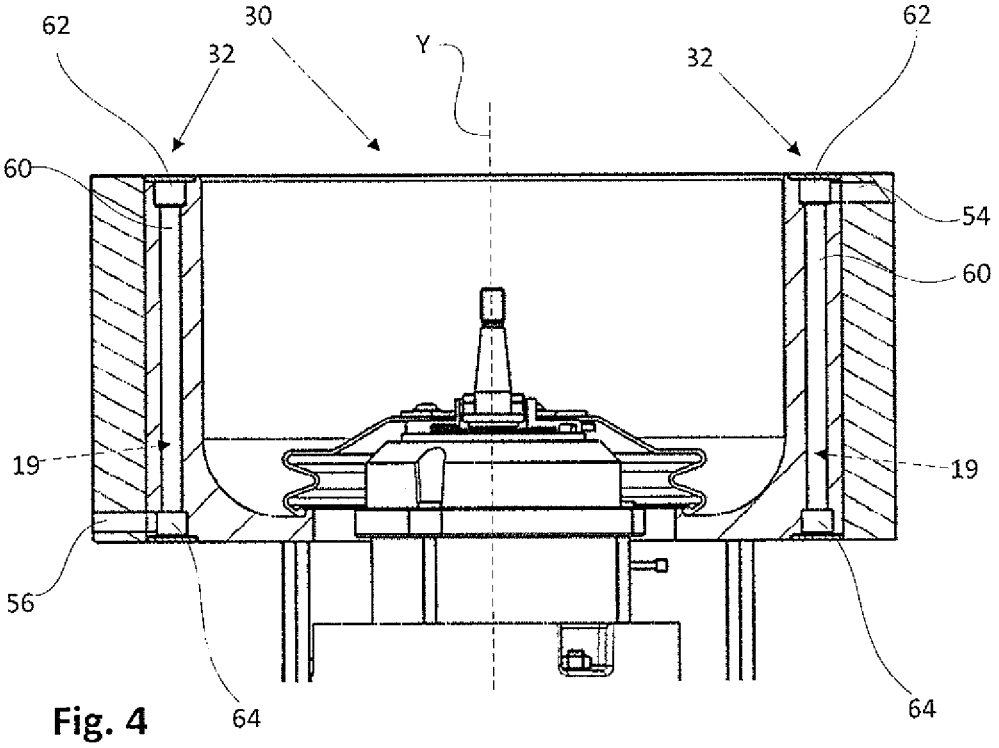
FIG. 4 is a lateral sectional view of the safety vessel of another centrifuge of the present invention.

FIG. 4 is a lateral sectional view of the safety vessel 30 of another centrifuge 10 of the present invention. In this embodiment, the vessel wall 32 has vertical circumferential cooling ducts 60 through which the heat transfer medium 19 flows, thereby extracting heat from the vessel wall 32. For distributing the heat transfer medium 19, which is conveyed from the refrigerating unit 12 to the vessel wall 32 via pipelines 18 and the feed line 54, to the individual cooling ducts 60, the vessel wall 32 has an annular manifold 62 which, from a vertical perspective, is mounted on the level of the feed line 54. Likewise, from a vertical perspective, a collector duct 64 is provided on the level of the discharge line 56, which collects the heat transfer medium 19 after it has passed through the cooling ducts 60 and conveys it to the discharge line 56. From the discharge line 56, the heat transfer medium 19 then flows back to the refrigerating unit 12.

Figure 5:
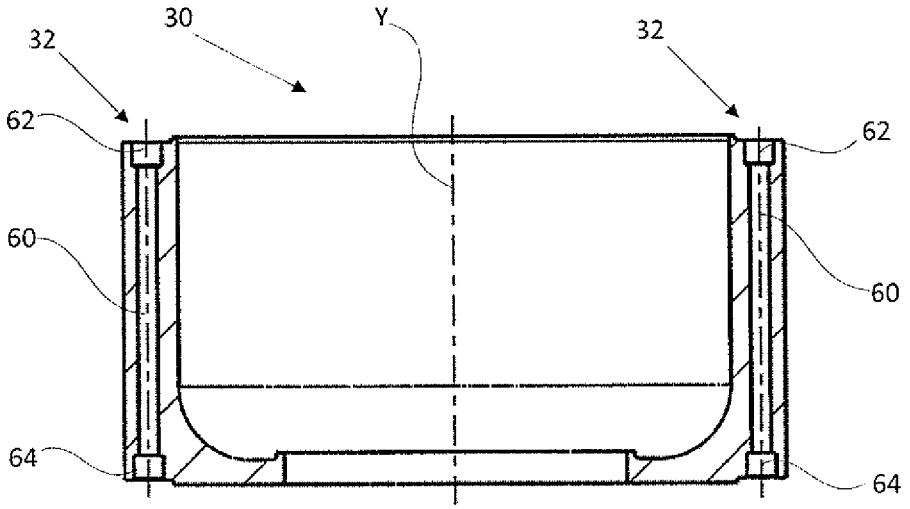
FIG. 5 is a partial view of the safety vessel of FIG. 4 in cross-section.
Figure 6:
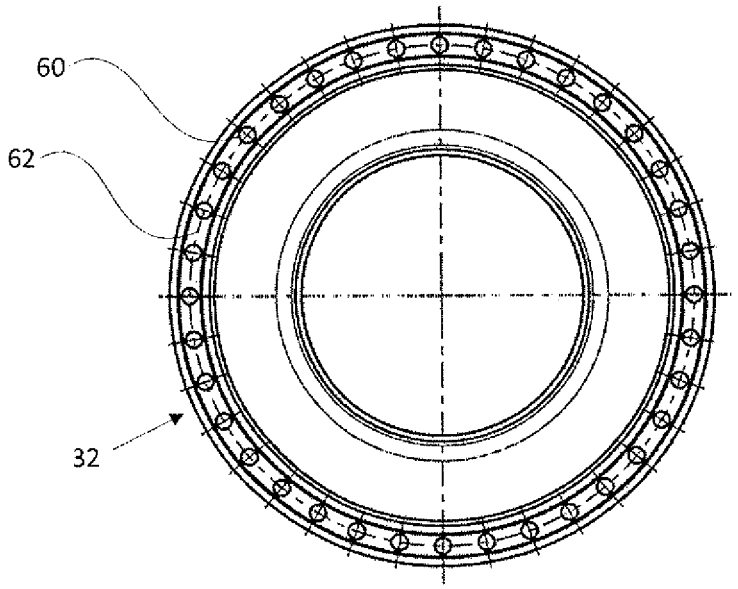
FIG. 6 is a partial view of the safety vessel of FIG. 4 in top view.

For further clarification, the arrangement of the cooling ducts 60, the manifold 62 and the collector duct 64 is shown in more detail in the views of FIGS. 5 and 6. Also, it is possible to reverse the arrangement of the feed line 54 and the discharge line 56 and thus also the functions of the manifold 62 and of the collector duct 64, so that the heat transfer medium 19 will then flow along the safety vessel 30 from bottom to top, instead of from top to bottom.

FIG. 5 is a lateral sectional view of the safety vessel 30 of FIG. 4. FIG. 6 is a top view of the safety vessel 30, illustrating the arrangement of the cooling ducts 60 in the vessel wall 32 as well as the manifold.

Figure 7:
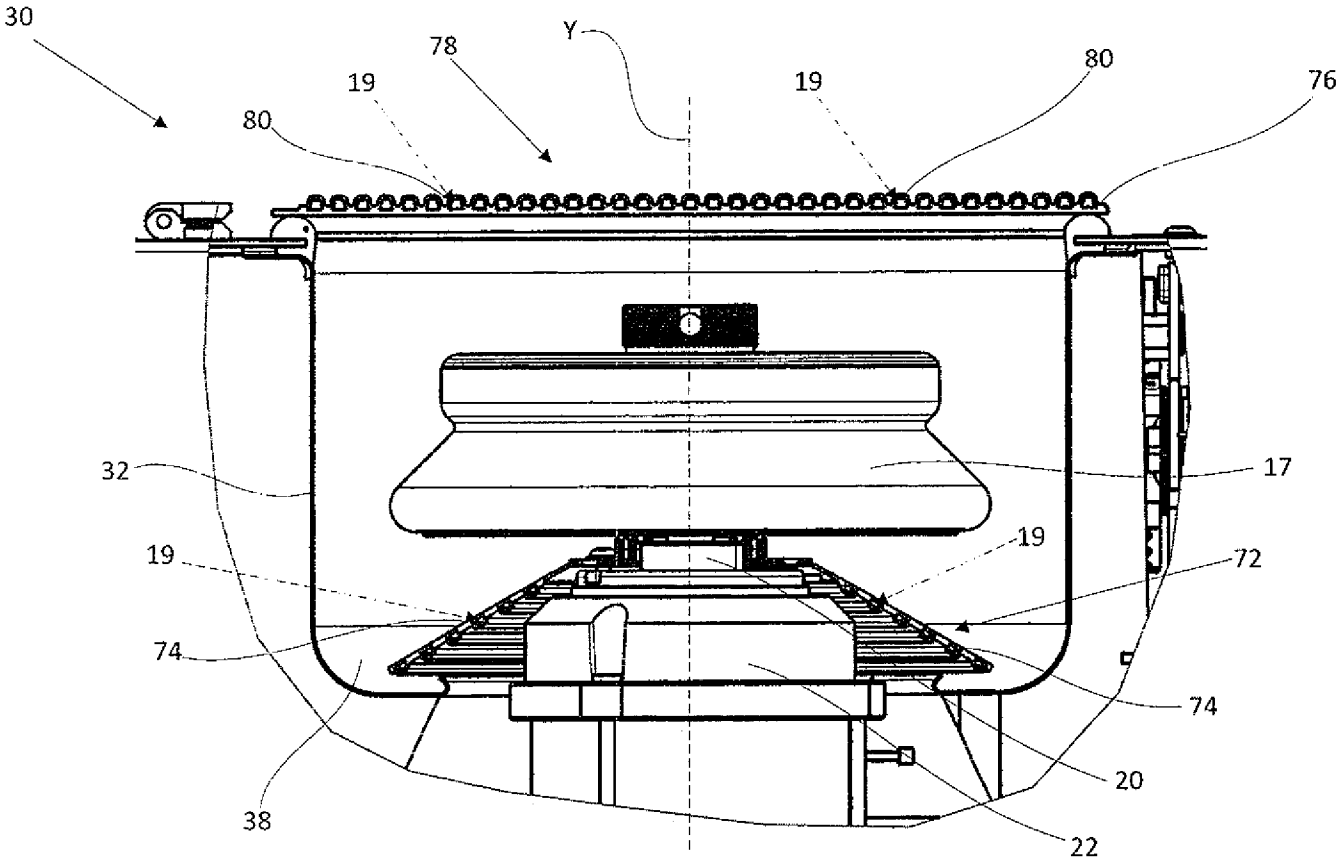
FIG. 7 is a lateral sectional view of the safety vessel of a centrifuge of the present invention with a cooled lid and motor cooling.

FIG. 7 is a view of a safety vessel 30 of another embodiment of a centrifuge 10 of the invention, which has a cooling device. Provided on a drive device 22, which is mounted concentrically relative to a central axis Y of the safety vessel 30 and which in parts extends through a vessel bottom 38, is a cover hood 72 which is likewise mounted concentrically relative to the central axis Y of the safety vessel 30 and on which flexible cooling pipes 74 are mounted. The diameter of the cover hood 72 tapers from the side adjacent to the vessel bottom 38 towards the top, to the side remote from the vessel bottom 38. The cooling pipes 74 are connected to the magnetocaloric refrigerating unit via flexible feed and discharge lines not shown in this Figure.

Instead of the cover hood 72, it is also conceivable to provide conducting means for the heat transfer medium 19 which are incorporated in the drive device 22 and connected to the refrigerating unit.

Above the cover hood 76, a rotor 17 is connected to the drive device 22 via a drive shaft 20.

For closing the safety vessel 30, a centrifuge lid 72 is provided on the side opposite the vessel bottom 38. Mounted on the exterior 74 of this lid 72 which faces away from the interior of the safety vessel 30 are cooling ducts 80 which are connected to the magnetocaloric refrigerating unit via feed and discharge lines not shown in this Figure. In this way, the safety vessel 30 is cooled both by the cover hood 72 in the area of the vessel bottom 38, and by the centrifuge lid 76 located above the rotor 17.

LIST OF REFERENCE SIGNS

10 centrifuge
12 magnetocaloric refrigerating unit
13 cooling aggregate
14 pump device
14*a* pump—first cooling circuit
14*b* pump—second cooling circuit
15 heat exchanger
16 regulating unit
17 rotor
18 conducting means
19 heat transfer medium
20 drive shaft
22 drive device
24 fastening struts
26 base plate
30 safety vessel
31 safety vessel interior space
32 vessel wall
34 interior
36 exterior
38 vessel bottom
40 interior wall
42 exterior
44 exterior wall
48 intermediate space
50 first end portion
51 seal
52 second end portion
53 seal
54 feed line
56 discharge line
58 insulation
60 cooling ducts
62 manifold
64 collector duct
66 heat exchanger
66*a,b* heat exchanger plates
68 cooling ducts
72 cover hood
74 cooling pipes
76 centrifuge lid
78 exterior
80 cooling ducts
100 centrifuge
102 cooling aggregate
104 ventilator
106 heat exchanger
110 cold side
111 first cooling circuit
112 warm side
113 second cooling circuit
114 ambient air
Y central axis
$Q_1$ cold side heat flow
$Q_2$ warm side heat flow

The invention claimed is:

1. A centrifuge (10), comprising:

a cylindrical safety vessel (30) includes a cylindrical vessel wall (32);

said cylindrical vessel wall (32) includes an interior wall (40) and an exterior wall (44), said interior wall (40) and said exterior wall (44) of said cylindrical safety vessel form an unimpeded cylindrical intermediate space (48);

said cylindrical safety vessel (30) includes an interior space (31);

a rotor (17) is arranged in said interior space (31) of said cylindrical safety vessel (30), said rotor is connected via a drive shaft (20) to a drive device (22);

said drive shaft (20) extends through said cylindrical safety vessel (30) to rotate said rotor;

said interior wall (40) of said cylindrical safety vessel faces said rotor (17);

said interior wall (40) being in contact with said interior space (31), and heat is generated by said rotating rotor in said interior space (31);

a magnetocaloric refrigeration unit (102);

a first fluid passageway through said magnetocaloric refrigeration unit (102) and a second fluid passageway through said magnetocaloric refrigeration unit (102);

a first cooling circuit (111);

a first heat transfer medium (19) resides in said first cooling circuit (111);

said first cooling circuit includes said unimpeded cylindrical intermediate space (48) of said cylindrical safety vessel and said first cooling circuit includes said first fluid passageway through said magnetocaloric refrigeration unit (102);

said first cooling circuit includes a first set of low pressure lines (111) for an operating pressure of up to 3 bar;

said first set of low pressure lines of said first cooling circuit (111) being interconnected with said unimpeded cylindrical intermediate space (48) of said cylindrical safety vessel and said low pressure lines of said first cooling circuit (111) being interconnected with said first fluid passageway of said magnetocaloric refrigeration unit;

said first heat transfer medium in direct contact with said interior wall (40) and said exterior wall (44) of said cylindrical safety vessel, and heat is transferred from said interior space (31) through said interior wall of said cylindrical safety vessel and to said first heat transfer medium;

a first pump (14*a*) for pumping said first heat transfer medium (19) through said first set of low pressure lines (111), said unimpeded cylindrical intermediate space (48) of said cylindrical safety vessel, and said first fluid passageway of said magnetocaloric refrigeration unit;

a second cooling circuit (113);

said second cooling circuit includes a second set of low pressure lines (113) for an operating pressure of up to 3 bar;

a heat exchanger in said second cooling circuit (113);

a second heat transfer medium resides in said second cooling circuit (113);

said second set of low pressure lines (113) interconnected with said heat exchanger and with said second fluid passageway of said magnetocaloric refrigeration unit;

a second pump (14*b*) for pumping said second heat transfer medium through said second set of low pressure lines (113), said heat exchanger (106) and said second fluid passageway of said magnetocaloric refrigeration unit (102);

said magnetocaloric refrigeration unit extracts heat from said first heat transfer medium (19) of said first cooling circuit as it passes through said first fluid passageway of said magnetocaloric refrigeration unit (102) and feeds said heat to second heat transfer medium in said second fluid passageway of said magnetocaloric refrigeration unit; and, said second heat transfer medium passes through said heat exchanger (106) thereby releasing heat to the ambient surroundings.

2. The centrifuge as claimed in claim 1, characterized in that cooling water is used as one of said first or second heat transfer mediums (19), said cooling water contains additives selected from the group consisting of salt and alcohol which act to lower the freezing point.

3. The centrifuge as claimed in claim 1, characterized in that a control or regulating unit (16) is provided to control said magnetocaloric refrigerating unit (12) and thus to adjust the temperature of said interior space (31) of said cylindrical safety vessel (30).

4. The centrifuge as claimed in claim 1, characterized in that said first heat transfer medium (19) is concentrically guided about a central axis in (Y) of said cylindrical safety vessel (30).

5. The centrifuge as claimed in claim 1, characterized in that said interior wall (40) is an interior vessel and said exterior wall (44) is an exterior vessel, and that said interior and exterior vessels are arranged concentrically to one another, with said interior and exterior vessels being matched to each other in proportion so as to obtain a uniform spacing between said interior wall (40) and said exterior wall (44).

6. The centrifuge as claimed in claim 1, characterized in that said first cooling circuit is incorporated into the material of said cylindrical vessel wall (32) of the cylindrical safety vessel (30).

7. The centrifuge as claimed in claim 1, characterized, in that:

said cylindrical safety vessel (30) includes a bottom (38);

a feed line (54) of said first heat transfer medium (19) is connected to said unimpeded intermediate space (48) of said cylindrical safety vessel (30) and a discharge line (56) of said first heat transfer medium (19) is connected to said unimpeded intermediate space (48).

8. A centrifuge (10), comprising;

a cylindrical safety vessel (30) includes a cylindrical vessel wall (32);

said cylindrical safety vessel (30) and said cylindrical vessel wall (32) include a vertical central axis (Y);

said cylindrical vessel wall includes vertical cooling ducts therein parallel to said vertical central axis and being circumferentially arranged about said cylindrical safety vessel;

said cylindrical safety vessel (30) includes an interior space (31);

a rotor (17) is arranged in said interior space (31) of said cylindrical safety vessel (30), said rotor is connected via a drive shaft (20) to a drive device (22);

said drive shaft (20) extends through said cylindrical safety vessel (30);

a magnetocaloric refrigeration unit (102);

a first fluid passageway through said magnetocaloric refrigeration unit (102) and a second fluid passageway through said magnetocaloric refrigeration unit (102);

a first cooling circuit (111);

a first heat transfer medium (19) resides in said first cooling circuit (111);

said first cooling circuit includes said vertical cooling ducts (60) of said cylindrical safety vessel and said first cooling circuit includes said first fluid passageway through said magnetocaloric refrigeration unit (102);

said first cooling circuit includes a first set of low pressure lines (111) for an operating pressure of up to 3 bar;

said first set of low pressure lines of said first cooling circuit (111) interconnected with said vertical cooling ducts of said cylindrical safety vessel and said low pressure lines of said first cooling circuit (111) interconnected with said first fluid passageway of said magnetocaloric refrigeration unit;

said first heat transfer medium in direct contact with said vertical cooling ducts, and heat is transferred from said interior space (31) through said interior wall of said cylindrical safety vessel and to said first heat transfer medium;

a first pump (14*a*) for pumping said first heat transfer medium (19) through said first set of low pressure lines (111), said vertical cooling ducts (60) of said cylindrical safety vessel, and said first fluid passageway of said magnetocaloric refrigeration unit;

a second cooling circuit (113);

said second cooling circuit includes a second set of low pressure lines (113) for an operating pressure of up to 3 bar;

said second cooling circuit includes a heat exchanger (106);

a second heat transfer medium resides in said second cooling circuit (113);

said second set of low pressure lines (113) interconnected with said heat exchanger and with said second fluid passageway of said magnetocaloric refrigeration unit;

a second pump (14*b*) for pumping said second heat transfer medium through said second set of low pressure lines (113), said heat exchanger (106) and said second fluid passageway of said magnetocaloric refrigeration unit (102);

said magnetocaloric refrigeration unit extracts heat from said first heat transfer medium (19) of said first cooling circuit as it passes through said first fluid passageway of said magnetocaloric refrigeration unit (102) and feeds said heat to second heat transfer medium in said second fluid passageway of said magnetocaloric refrigeration unit; and, said second heat transfer medium passes through said heat exchanger (106) thereby releasing heat to the ambient surroundings.

9. The centrifuge as claimed in claim 8, characterized in that an annular collector duct (64) for said vertical cooling ducts extends in one plane to a discharge line (56) of said first heat transfer medium.

10. The centrifuge as claimed in claim 8, characterized in that an annular manifold (62)) for said vertical cooling ducts extends in one plane from a feed line (54) of said first heat transfer medium.

* * * * *